US008490587B2

(12) United States Patent
Hale et al.

(10) Patent No.: US 8,490,587 B2
(45) Date of Patent: Jul. 23, 2013

(54) CAM DRIVE

(75) Inventors: Thomas Hale, Northampton (GB); Jonathan Hall, Northampton (GB); Hermann Hoffmann, Stuttgart (DE)

(73) Assignee: Mahle International GmbH (DE)

( * ) Notice: Subject to any disclaimer, the term of this patent is extended or adjusted under 35 U.S.C. 154(b) by 889 days.

(21) Appl. No.: 12/373,375

(22) PCT Filed: Jul. 4, 2007

(86) PCT No.: PCT/EP2007/056752
§ 371 (c)(1),
(2), (4) Date: Dec. 15, 2009

(87) PCT Pub. No.: WO2008/009557
PCT Pub. Date: Jan. 24, 2008

(65) Prior Publication Data

US 2010/0101515 A1 Apr. 29, 2010

(30) Foreign Application Priority Data

Jul. 19, 2006 (DE) ..... 10 2006 033 403

(51) Int. Cl.
*F01L 1/34* (2006.01)

(52) U.S. Cl.
USPC ..... 123/90.16; 123/90.39; 123/90.44

(58) Field of Classification Search
USPC ..... 123/90.15, 90.16, 90.39, 90.41, 90.44, 123/90.45
See application file for complete search history.

(56) References Cited

U.S. PATENT DOCUMENTS

| | | | |
|---|---|---|---|
| 4,151,817 | A | 5/1979 | Mueller |
| 4,519,345 | A | 5/1985 | Walter |
| 4,640,495 | A | 2/1987 | Parsons |
| 5,529,033 | A | 6/1996 | Hampton |

(Continued)

FOREIGN PATENT DOCUMENTS

| | | |
|---|---|---|
| DE | 3003569 | 8/1981 |
| DE | 4000531 | 6/1990 |

(Continued)

OTHER PUBLICATIONS

English abstract for DE-19956159.

(Continued)

*Primary Examiner* — Thomas Denion
*Assistant Examiner* — Daniel Bernstein
(74) *Attorney, Agent, or Firm* — Rader, Fishman & Grauer PLLC

(57) ABSTRACT

The present invention relates to a cam drive (1) having a camshaft and having cams (18, 18')arranged thereon and having at least one rocker arm (3) which has a cam follower (2) and which is operatively connected by means of its first arm (4) to a plunger-like bearing (5) and by means of its second arm (6) to at least one gas exchange valve (7) of an associated cylinder. The cam drive (1) also has a device (10) for varying the lift of the at least one gas exchange valve (7). Here, it is essential to the invention that the device (10) is embodied as a clutch device which acts between the plunger-like abutment (5) and the rocker arm (3, 3', 3")and which has an actuating element (12) which is mounted so as to be rotatable about an axis (13) of the plunger-like abutment (5) at least between two positions, wherein a valve lift in a first, coupled position of the actuating element (12) is varied in comparison with a second, decoupled position.

20 Claims, 4 Drawing Sheets

U.S. PATENT DOCUMENTS

Figure 2:
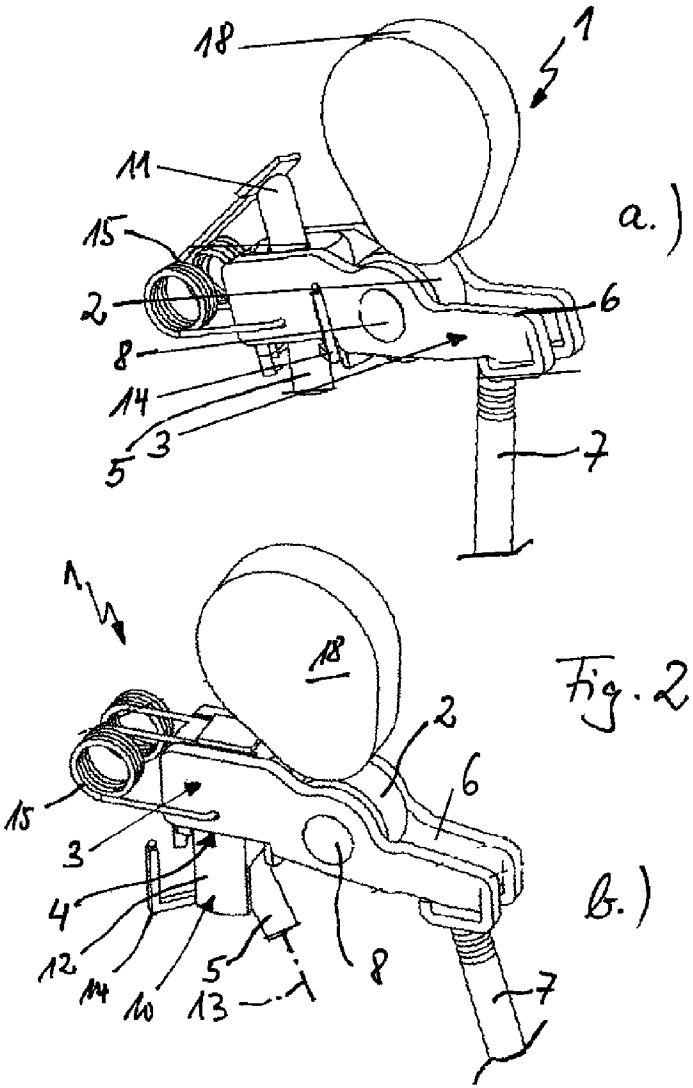

| | | | | |
|---|---|---|---|---|
| 5,655,487 | A | 8/1997 | Maas et al. | |
| 5,682,848 | A | 11/1997 | Hampton et al. | |
| 5,960,756 | A * | 10/1999 | Miyachi et al. | 123/90.16 |
| 6,273,039 | B1 | 8/2001 | Church | |
| 6,314,927 | B1 | 11/2001 | Schnell | |
| 6,314,928 | B1 | 11/2001 | Baraszu et al. | |
| 6,318,318 | B1 * | 11/2001 | Jahr | 123/90.16 |
| 6,460,495 | B1 | 10/2002 | Seitz et al. | |
| 6,591,798 | B2 * | 7/2003 | Hendriksma et al. | 123/90.16 |
| 6,655,331 | B2 | 12/2003 | Duesmann et al. | |
| 6,752,107 | B2 * | 6/2004 | Kreuter | 123/90.16 |
| 2006/0042582 | A1 | 3/2006 | Sailer et al. | |

FOREIGN PATENT DOCUMENTS

| | | | |
|---|---|---|---|
| DE | 4238325 | | 5/1994 |
| DE | 19536090 | | 4/1997 |
| DE | 19819068 | | 4/1999 |
| DE | 19956159 | A1 | 5/2001 |
| DE | 19959159 | | 6/2001 |
| DE | 10158703 | | 7/2002 |
| DE | 10125701 | | 11/2002 |
| DE | 102004040808 | | 3/2006 |
| EP | 1493902 | | 1/2005 |
| FR | 2861130 | | 4/2005 |
| JP | 58-79637 | | 5/1983 |
| JP | 59-103912 | | 6/1984 |
| JP | 60-230504 | | 11/1985 |

OTHER PUBLICATIONS

English abstract provided for FR-2861130.
English abstract provided for DE-4238325.
English abstract provided for DE-10125701.
English abstract provided for DE-19536090.
English abstract provided for DE-19959159.
English abstract provided for DE-3003569.
English abstract provided for DE-40000531.
English abstract provided for EP-1493902.

* cited by examiner

CAM DRIVE

CROSS-REFERENCES TO RELATED APPLICATION

This application is a National Stage application which claims the benefit of International Application No. PCT/EP2007/056752 filed Jul. 4, 2007, which claims priority based on German Patent Application No. DE 102006033403.5,filed Jul. 19, 2006, both of which are hereby Incorporated by reference in their entirety.

The invention relates to a cam drive having a camshaft and having cams arranged thereon and having at least one rocker arm which has a cam follower according to the preamble of the claim 1.

To be able to further reduce the energy consumption of motor vehicles, in particular in the case of internal combustion engines having a higher number of cylinders, individual or more cylinders can be shut-off during an operation of the motor vehicle at partial load or can be operated at least energy-reduced. Devices for influencing a valve control, in particular for shutting-off individual cylinders, are known from a high number of publications, whereof hereinafter the most obvious ones are explained briefly.

From U.S. Pat. No. 5,529,033, a device is known for a cam drive having a camshaft with cams arranged thereon, by means of which a valve lift of at least one gas exchange valve can be varied. For this, the cam drive has at least one rocker arm which has a cam follower, and which is actively connected via its first arm with a plunger-like abutment and via its second arm with the at least one gas exchange valve of the associated cylinder. The rocker arm has an inner and an outer rocker arm which is supported by means of a slotted hole so that the inner rocker arm can be axially moved relative to the outer rocker arm, which results in varying of the valve lift. Such an axial movement of the outer rocker arm relative to the inner rocker arm is actuated by an electromagnet.

From U.S. Pat. No. 5,682,848, a further device is known for varying a lift of a gas exchange valve of an internal combustion engine, wherein the device, in addition to an electromagnetic spring, has at least one further arm, in particular an axially telescoping actuator arm. At the same time, a control unit for controlling the device is also needed, wherein all of the above mentioned components, excluding the control unit, are accommodated in the area of the cylinder head and hence require an installation space which is not be underestimated. Moreover, the known device is relatively complicated and thereby expansive.

Further devices for varying a lift of gas exchange valves in internal combustion engines are known, for example, from U.S. Pat. No. 4,151,817, from U.S. Pat. No. 5,655,487, from U.S. Pat. No. 6,460,495 B1, from U.S. Pat. No. 6,752,107 B2 and from U.S. Pat. No. 6,655,331 B2.

The invention is concerned with the problem to propose for a cam drive of the generic type, an improved embodiment which is characterized in particular by a structurally simple design and an arrangement of the device for varying the lift of a gas exchange valve at stationary parts.

This problem is solved by means of the subject matter of the independent claim 1.

Advantageous embodiments are subject matter of the dependent claims.

The invention is based on the general idea, for a cam drive having a camshaft and having cams arranged thereon and having at least one rocker arm which, on the one hand, is actively connected with a plunger-like abutment and, on the other hand, with at least one gas exchange valve of an associated cylinder, to form a device for varying the lift of the at least one gas exchange valve in the manner of a rotatable actuating element, wherein the actuating element is supported so as to be rotatable about an axis of the plunger-like abutment at least between two end positions, preferably between two end positions, and wherein a valve lift in a first position of the actuating element is smaller or bigger as in comparison to a second position of the actuating element. In the case of two end positions, the rocker arm is located with respect to the plunger-like abutment in one end position in a coupled state and in the other end position in a decoupled state. Conceivably, here that the actuating element is rotatably supported only between the two end positions, wherein it generates in a first end position, a normal, in particular, maximal valve lift of the gas exchange valve, while it generates, in its second end position, a reduced or even no valve lift, wherein the latter equates with a cylinder shut-off. Different intermediate positions between the end positions are certainly also possible here, whereby a particularly accurate control of the valve lift is enabled. Such a rotatable actuating element is simple to manufacture with respect to the design and is thereby inexpensive.

Advantageously, the device is arranged between the first arm of the rocker arm and the plunger-like abutment. This offers the advantage that for the arrangement of the device according to the invention almost no additional space is required so that the device can also be used in restricted space conditions which are often found in the area of cylinder heads. An actuating device for actuating the actuating element can be arranged, for example, in the form of an actuating drive and can be used selectively for one or more actuating elements. It is in particular conceivable here that to each actuating element, a separate actuating device is allocated, or that a plurality of actuating elements is actuated by a common actuating device.

In a further advantageous embodiment of the solution according to the invention, the rocker arm is formed in two parts and has an outer and an inner rocker arm, wherein the actuating element rests in a first position against the outer rocker arm so that the same is in contact with a first cam and can carry out an oscillating tilting movement, which causes an actuating of the gas exchange valve of the associated cylinder. In contrast, the actuating element is displaced with respect to the outer rocker arm in a second position, for example in a second end position, and, in doing so, rests solely against the inner rocker arm so that the inner rocker arm is in contact with a second cam of the cam shaft and can carry out an oscillating tilting movement, which causes a varied actuating of the associated gas exchange valve in comparison to the first position. In this embodiment, it is hence possible, depending on the embodiment of the two cams, to influence the valve lift of the associated gas exchange valve. Here, a shut-off of the cylinder, hence no valve lift, is conceivable as well as a so-called "cylinder switching", wherein here the second cam has a different form than the first cam and generates a varied, in particular, reduced valve lift compared to the first position of the actuating element. Depending on the form of the inner or outer rocker arm, respectively, and of the two associated cams on the camshaft, a particularly exact and fine-adjusted control of the valve lift is accomplished, wherein a particularly energy-saving operation of the internal combustion engine and a reduction of the energy cost can be achieved.

Advantageous exemplary embodiments, which are explained hereinafter in more detail, are illustrated in the drawings.

Figure 1:
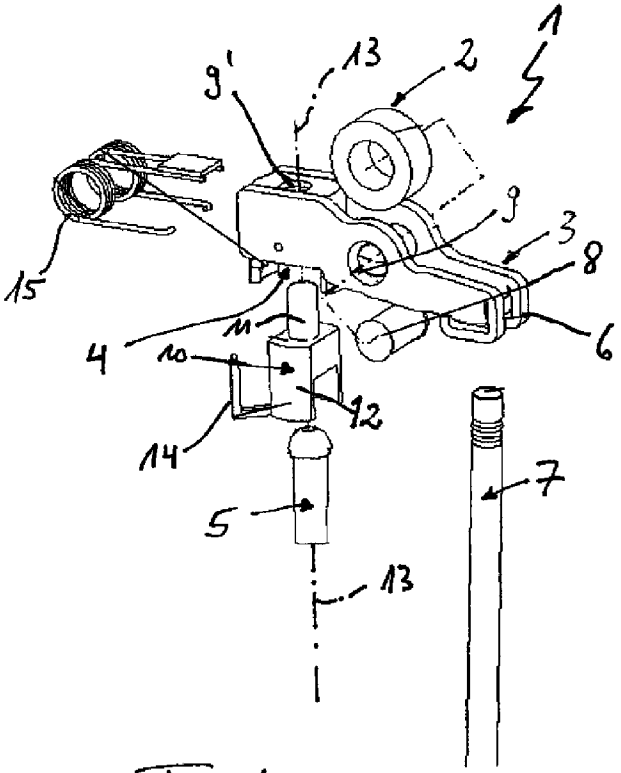
Figure 3:
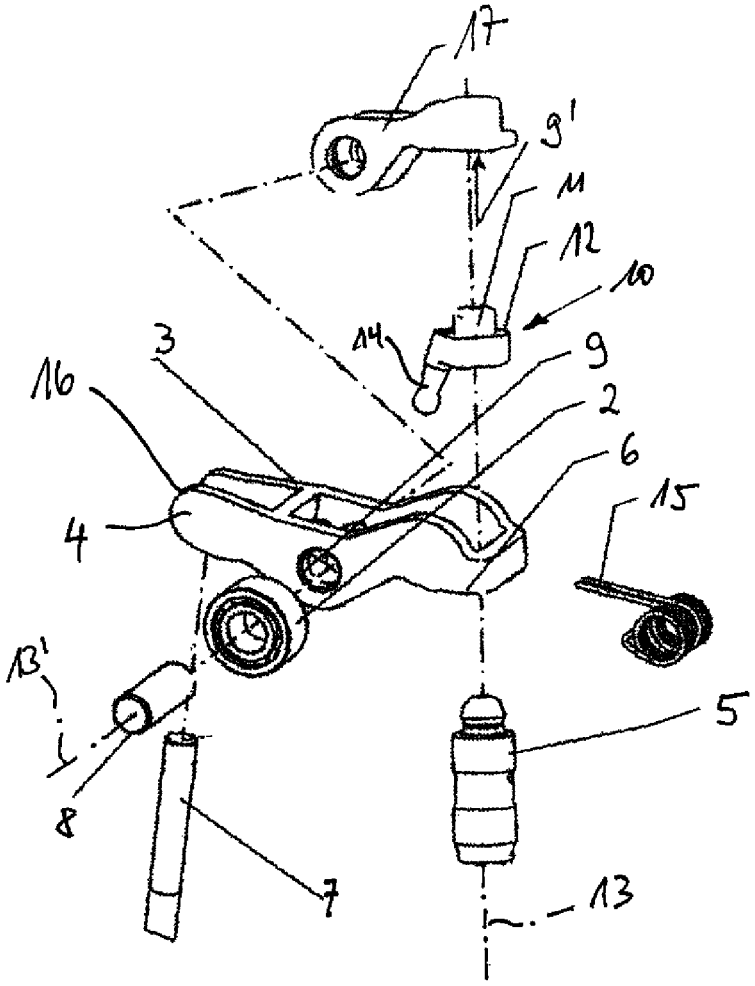
Figure 4:
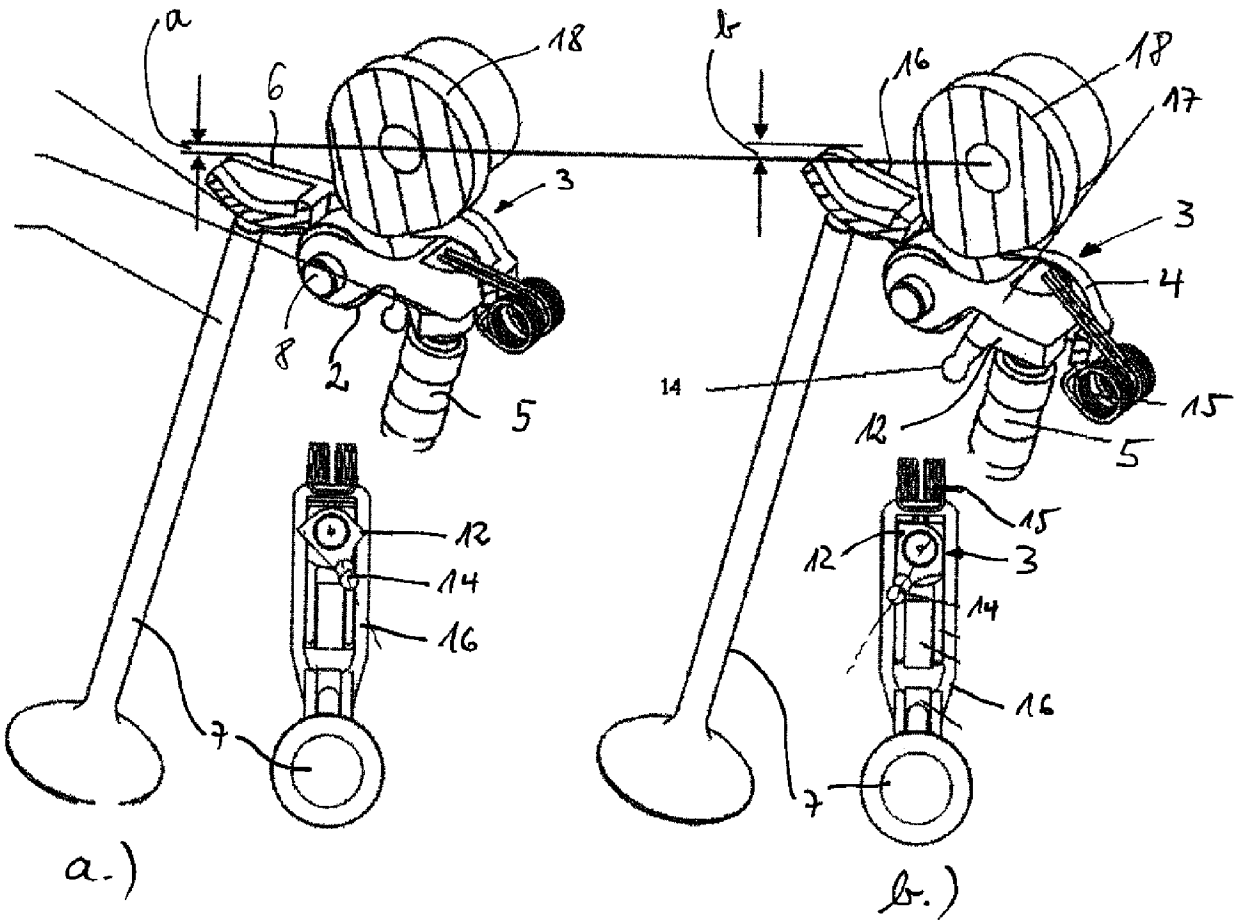
Figure 5:
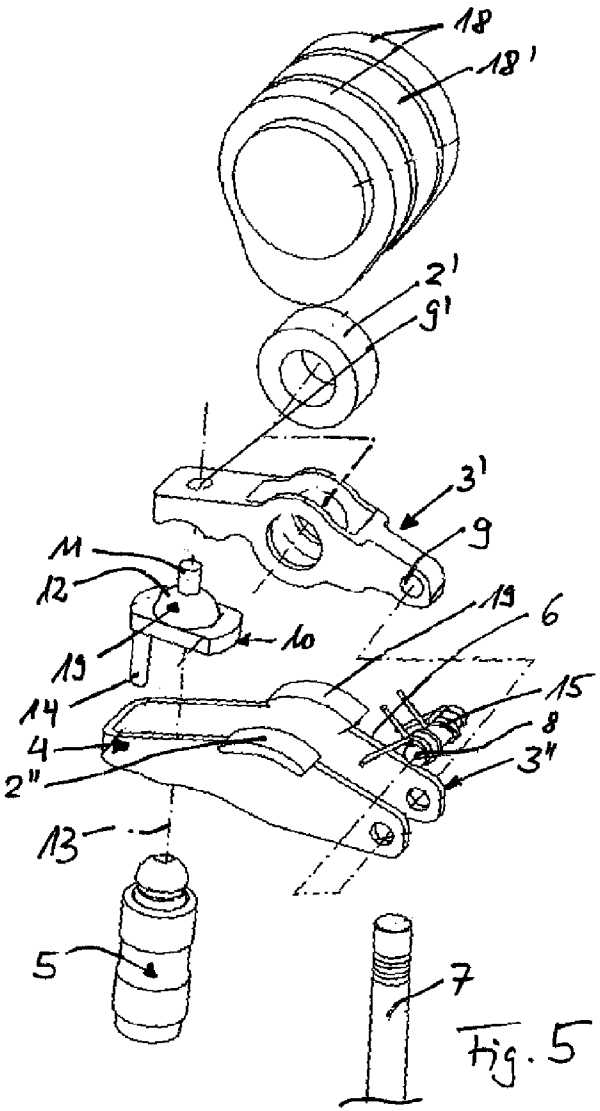

In the figures, in each case schematically and in a perspective view:

FIG. 1 shows a an exploded view of a first embodiment of a device for varying a valve lift, FIG. 2*a* shows a device according to FIG. 1 during a cylinder shut-off, FIG. 2*b* shows an illustration as in FIG. 2*a* but with varied valve lift, FIG. 3 shows an exploded view of a device with a different structure for varying a valve lift, FIG. 4*a* shows a device as in FIG. 3 with an actuating element being in a first end position, FIG. 4*b* shows an illustration as in FIG. 4*a* but with an actuating element being in a second end position and hence with a varied valve lift, FIG. 5 shows an exploded drawing of a further embodiment of a device for varying the valve lift, FIG. 6*a* shows a device according to FIG. 5 with an actuating element in its first end position, FIG. 6*b* shows an illustration as in FIG. 6*a* but with an actuating element in its second end position and hence with a varied valve lift.

FIG. 1, 2

According to FIG. 1, a part of the cam drive 1 is shown, which comprises a not-shown cam shaft with cams 18 arranged thereon, as well as a rocker arm 3 having a cam follower 2. The rocker arm 3 is actively connected by means of its first arm 4 with a plunger-like abutment 5 and by means of its second arm 6 with at least one gas exchange valve 7 of an associated not-shown cylinder. The cam follower 2 is formed according to FIG. 1 as a ring which is retained by means of a pin 8 in a seat 9 on the rocker arm 3. Between the first arm 4 of the rocker arm 3 and the abutment 5, a device 10 for varying the lift of the at least one gas exchange valve 7 is provided. The device 10 for varying the lift of the gas exchange valve 7 has on the rocker arm-side a guide pin 11, by means of which the device engages with an associated seat 9' within the first arm 4 of the rocker arm 3. On the abutment side, the device 10 has a support face, which is formed complementary to the abutment-side head, by means of which the device 10 is supported on the plunger-like abutment 5.

In general, the device 10 for varying the lift of the at least one gas exchange valve 7 has an actuating element 12 at which the guide pin 11 is arranged. According to the invention, the actuating element 12 is rotatably supported about an axis 13 of the plunger-like abutment 5 between two positions, wherein a valve lift in a first, coupled position (compare FIG. 2*a*) of the actuating element 12 is varied in comparison with a second, decoupled position (compare FIG. 2*b*). A rotational movement can be carried out here by means of an actuator arm 14 which, for example, is connected to a not-shown actuator, in particular to an actuating drive, or is actively connected with the same, respectively. It is conceivable here that to each actuator an actuating element 12 is allocated or that a plurality of actuating elements 12 is controlled by one and the same actuator.

At the first arm 4 of the rocker arm 3, a spring device 15 is provided, which pretensions the rocker arm 3 or the first arm 4 of the rocker arm 3, respectively, against the associated, not-shown cam of the camshaft. For this, the spring device 15 is formed as a leg spring and engages, on the one hand, with the second arm 6 of the rocker arm 3 and, on the other hand, with the guide pin 11 of the actuating element 12 as an abutment.

During the operation of the cam drive 1, the rocker arm 3 carries out a tilting movement, wherein the tilting axis varies depending on the position of the actuating element 12. In the position of the actuating element 12 in its second end position (compare FIGS. 1 and 2*a*), the actuating element 12 plunges during the oscillating tilting movement of the rocker arm 3 at least partly into the same, wherein the rocker arm 3 then carries out a tilting movement about the free end of the second arm 6 without causing an actuation of the associated gas exchange valve 7. If, however, the actuating element 12 is rotated by 90°, (compare FIG. 2*b*), the actuating element 12 is then in a first position, in particular in a first end position, wherein it rests against the rocker arm 3 so that the same carries out an oscillating tilting movement which, causes an actuation of the gas exchange valve 7 of the associated cylinder.

The actuating element 12 hence can be rotated between at least two end positions, wherein the first end position results in a "normal" lift of the gas exchange valve 7, while the second end position causes a reduced lift, in particular a zero-lift, of the gas exchange valve 7. The latter is referred to as "cylinder shut-off". It is also thinkable here that between the two mentioned end positions of the actuating element 12, at least one intermediate position is provided in which the actuating element 12 does not plunge as deep into the second arm 4 of the rocker arm 3 as this is the case in the second end position, and hence causes a reduced valve lift of the gas exchange valve 7 compared to the first end position and to an increased valve lift compared to the second end position. Hence, a particularly exact control of the valve lift of the gas exchange valve 7 is possible.

FIG. 3

According to FIG. 3, a device 10 for varying the lift of the gas exchange valve 7 is shown, wherein the rocker arm 3 is formed in two parts, and a rocker arm element 16 as well as an arm 17 located inside in the rocker arm element 16 are provided. Similar to the FIGS. 1 and 2, also in the device 10 according to FIG. 3 a cam follower 2 is provided which is supported by means of a pin 8 at the rocker arm 3. In contrast to the FIGS. 1 and 2, the device 10 according to FIG. 3, however, has the inside arm 17 which is rotatable relative to the rocker arm 3 about the axis 13'.

Also in the device 10 according to the FIG. 3, a spring device 15 is provided which preferably is formed as a leg spring and which is arranged in the region of the second arm 6 of the rocker arm 3 or the free end of the same, respectively, and pretensions the rocker arm 3 against the associated cam of the camshaft, namely opposite to the abutment 5 by means of the inside arm 17. The actuating element 12 for varying the lift of the gas exchange valve 7 is formed different, unlike the FIGS. 1 and 2, in particular in the manner that between a first end position and a second end position, there is a difference of about 45° only. The actuating element 12 has also a guide pin 11 which is facing towards the inside arm 17 and arranged at the actuating element 12, and which in the assembled device 10 engages with a corresponding seat 9' at the inside arm 17. On its side facing towards the plunger-like abutment 5, the actuating element 12 has a support face which is formed complementary to a head of the plunger-like abutment 5 and which ensures a reliable interaction between the actuation element 12 and the abutment 5.

FIG. 4

As shown in FIG. 4*a*, in the embodiment of FIG. 3, the actuating 12 is in its first position, in particular in its first end position, and rests against the rocker arm element 16 so that the same carries out an oscillating tilting movement, which causes an actuating of the associated gas exchange valve 7. In contrast to that, the actuating element 12 according to FIG. 4*b* is rotated by 45° and is hence in a second position, in particular in a second end position, in which it plunges at least partly into the rocker arm element 16 and rests solely against the inside arm 17 so that the rocker arm element 16 carries out a tilting movement about the free end of its second arm 6 without causing an actuating of the associated gas exchange valve 7. Since a cam 18 in the FIG. 4*a* as well as in the FIG. 4*b* takes the same position, a different valve lift between the two Figures can be clearly identified. A valve lift difference between FIGS. 4*a* and 4*b* is the result of an addition of the valve lift variation a and b according to the FIGS. 4*a* and b. Here, it is also thinkable that a valve lift with the actuating element 12 being in its first end position turns out considerably varied compared to a valve lift with the actuating element 12 being in its second end position. It is in particular conceivable that the valve lift in the second end position of the actuating element 12 is severely reduced, or, in the extreme case, is zero so that in this case the associated gas exchange valve 7 does not move by a valve lift, which results in a cylinder shut-off.

Between the two end positions of the actuating element 12, further intermediate positions are thinkable, in any case at least one, in which a valve lift is varied in comparison to the first end position of the actuating element 12 and in comparison to the second end position of the actuating element 12. Hence, a particularly accurate control of the valve lift can be achieved.

FIG. 5, 6

Figure 6:
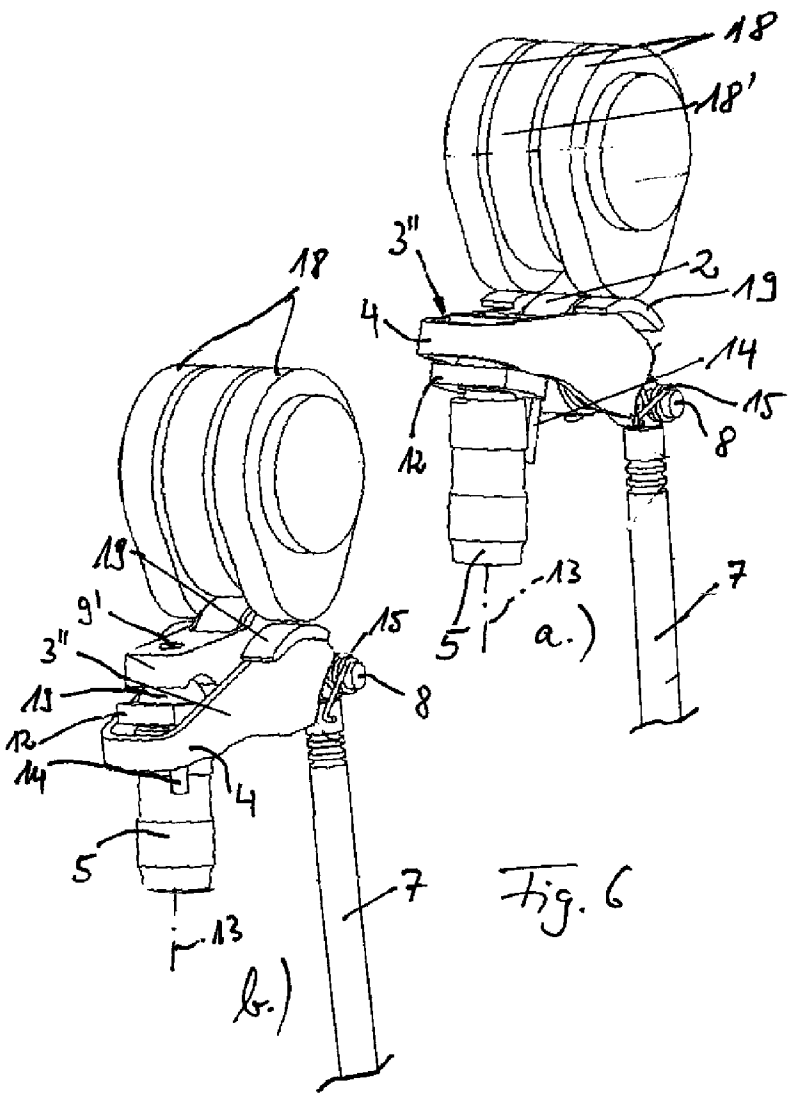

According to FIGS. 5 and 6, a device 10 is shown in which the rocker arm 3 is formed in two parts and has two rocker arms 3' and 3" working independent from one another with two cam followers 2' and 2" working independent from one another. For this reason, hereinafter is differentiated between an inner rocker arm 3' and an outer rocker arm 3". Here, the cam follower 2' is formed identical or at least similar to the cam follower 2 according to the FIGS. 1 to 4, while the cam follower 2" is arranged as a sliding face 19 at the outer rocker arm 3". Again a spring device 15 is provided which is formed as a leg spring. The spring device 15 tensions the two rocker arms 3' and 3" towards one another.

At the second arm 6, the inner rocker arm 3' is rotatably supported at the outer rocker arm 3" by means of a pin 8. Another difference between the embodiments of the device 10 according to the FIGS. 1 to 4 and the FIGS. 5 and 6 is that in addition to the cam 18 further cams 18' are provided.

As in the FIGS. 1 to 4, according to FIG. 5, the actuating element 12 has also a guide pin 11 which engages with an associated seat 9' at the inner rocker arm 3', wherein in addition in the area of the guide pin 11, a spherical segment-like sliding face 19 is provided. As in the preceding FIGS. 1 to 4, the actuating element 12 according to the FIGS. 5 and 6 has also an actuator arm 14 which can be connected to a not-shown actuator.

In a first position, in particular in its first end position, the actuating element 12 rests against the outer rocker arm 3" (compare FIG. 6*a*) so that the same is in contact with a first cam 18 of the camshaft and carries out an oscillating tilting movement which causes an actuating of the gas exchange valve 7 of the associated cylinder. In its second position, however, in particular in a second end position, the actuating element 12 plunges at least partly into the outer rocker arm 3" and rests against the inner rocker arm 3' so that the inner rocker arm 3' is in contact with a second cam 18' of the camshaft and carries out an oscillating tilting movement, which causes a varied actuating of the associated gas exchange valve 7 compared to the first position (compare FIG. 6). As for the devices 10 according to the FIGS. 1 to 4, it is thinkable for the device 10 according to the FIGS. 5 and 6 that between the two end positions, intermediate positions are provided in which the valve lift of the gas exchange valve 7 is varied in comparison to the first end position and in comparison to the second end position. Depending on the embodiment of the first cams 18 or the second cams 18', respectively, thereby a reduction of the valve lift up to a complete shut-off of the associated cylinder can be achieved in the second end position of the actuating element 12.

Hence, with the device according to the FIGS. 5 and 6, the valve lift can be influenced depending on the embodiment of the two cams 18 and 18', whereby a control of the valve lift is possible which is much more precise in comparison to the control achievable in the FIGS. 1 to 4, provided that, independent from the embodiments of the device 10, no intermediate positions between the two end positions are provided.

All embodiments according to the FIGS. 1 to 6 have in common that the device 10, in particular the actuating element 12, is designed in a simple manner and is arranged with minimized installation space in the area of the first arm 4 of the rocker arm 3 between the same and the abutment 5. At the same time, the actuating element 12 concerns a component which is not moved during the normal operation of the internal combustion engine so that substantially a static device 10 for varying the valve lift is created which, in comparison to an internal combustion engine without the device 10 according to the invention, does not generate increased energy cost due to additional masses to be moved.

All features illustrated in the description and in the following claims can be essential for the invention, individually as well as combined with one another in any form.

The invention claimed is:

1. A cam drive, comprising:

a camshaft having cams arranged thereon, a plunger-shaped abutment including an axis;

at least one spring-loaded gas exchange valve of an associated cylinder;

at least one rocker arm which has a cam follower, a first arm, and a second arm, and where the rocker arm is actively connected by means of the first arm to the plunger-shaped abutment and by means of the second arm to the at least one gas exchange valve; and a device varying lift of the at least one gas exchange valve, the device including an actuating element;

wherein the device is formed as a clutch device which acts between the plunger-shaped abutment and the rocker arm and the actuating element is supported so as to be rotatable about the axis of the plunger-shaped abutment between at least a first coupled position and a second decoupled position;

wherein a valve lift of the at least one gas exchange valve in the first coupled position of the actuating element is varied in comparison with the second decoupled position.

2. The cam drive according to claim 1, wherein the actuating element is rotatable between two end positions by at least forty-five degrees (45°).

3. The cam drive according to claim 2, wherein the rocker arm is pretensioned by a spring device, which is arranged in a region of a free end of one of the first arm and the second arm of the rocker arm, against an associated cam of the camshaft.

4. The cam drive according to claim 2, wherein the actuating element rests in a first position against the rocker arm so that the rocker arm carries out an oscillating tilting movement which causes an actuating of the at least one gas exchange valve of the associated cylinder, while the actuating element plunges in a second position at least partly into the rocker arm so that the rocker arm carries out a tilting movement about a free end of the second arm without causing an actuating of the associated at least one gas exchange valve.

5. The cam drive according to claim 2, wherein the rocker arm is formed in two parts and has a rocker arm element comprising an inside arm supported therein, wherein the actuating element rests in a first position against the rocker arm element so that the rocker arm carries out an oscillating tilting movement which causes an actuating of the associated at least one gas exchange valve, while the actuating element, in a second position, rests in a displaceable manner with respect to the rocker arm element against the inside arm so that the rocker arm element carries out a tilting movement about a free end of the second arm without causing an actuating of the associated at least one gas exchange valve.

6. The cam drive according to claim 2, wherein the rocker arm is formed in two parts having two rocker arms which work independent from one another, each of the two rocker arms having one cam follower which works independent from the other, and where each of the two rocker arms are supported on an end facing towards the at least one gas exchange valve so that the two rocker arms can pivot with respect to one another.

7. The cam drive according to claim 6, wherein the rocker arm including the two rockers arms has an outer and an inner rocker arm.

8. The cam drive according to claim 7, wherein the actuating element rests in a first position against the outer rocker arm so that the outer rocker arm is in contact with a first cam of the camshaft and carries out an oscillating tilting movement, which causes an actuating of the at least one gas exchange valve of the associated cylinder, and in a second position, the actuating element rests against the inner rocker arm so that the inner rocker arm is in contact with a second cam of the camshaft and carries out an oscillating movement, which causes a varied actuating of the associated at least one gas exchange valve in comparison with the first position.

9. The cam drive according to claim 1, wherein the rocker arm is pretensioned by a spring device, which is arranged in a region of a free end of one of the first arm and the second arm of the rocker arm, against an associated cam of the camshaft.

10. The cam drive according to claim 9, wherein the spring device is a leg spring.

11. The cam drive according to claim 9, wherein the actuating element rests in a first position against the rocker arm so that the rocker arm carries out an oscillating tilting movement which causes an actuating of the at least one gas exchange valve of the associated cylinder, while the actuating element plunges in a second position at least partly into the rocker arm so that the rocker arm carries out a tilting movement about a free end of the second arm without causing an actuating of the associated at least one gas exchange valve.

12. The cam drive according to claim 9, wherein the rocker arm is formed in two parts and has a rocker arm element comprising an inside arm supported therein, wherein the actuating element rests in a first position against the rocker arm element so that the rocker arm carries out an oscillating tilting movement which causes an actuating of the associated at least one gas exchange valve, while the actuating element, in a second position, rests in a displaceable manner with respect to the rocker arm element against the inside arm so that the rocker arm element carries out a tilting movement about a free end of the second arm without causing an actuating of the associated at least one gas exchange valve.

13. The cam drive according to claim 9, wherein the rocker arm is formed in two parts having two rocker arms which work independent from one another, each of the two rocker arms having one cam follower which works independent from the other, and where each of the two rocker arms are supported on an end facing towards the at least one gas exchange valve so that the two rocker arms can pivot with respect to one another.

14. The cam drive according to claim 1, wherein the actuating element rests in a first position against the rocker arm so that the rocker arm carries out an oscillating tilting movement which causes an actuating of the at least one gas exchange valve of the associated cylinder, while the actuating element plunges in a second position at least partly into the rocker arm so that the rocker arm carries out a tilting movement about a free end of the second arm without causing an actuating of the associated at least one gas exchange valve.

15. The cam drive according to claim 14, wherein the rocker arm is formed in two parts and has a rocker arm element comprising an inside arm supported therein, wherein the actuating element rests in a first position against the rocker arm element so that the rocker arm carries out an oscillating tilting movement which causes an actuating of the associated at least one gas exchange valve, while the actuating element, in a second position, rests in a displaceable manner with respect to the rocker arm element against the inside arm so that the rocker arm element carries out a tilting movement about a free end of the second arm without causing an actuating of the associated at least one gas exchange valve.

16. The cam drive according to claim 14, wherein the rocker arm is formed in two parts having two rocker arms which work independent from one another, each of the two rocker arms having one cam follower which works independent from the other, and where each of the two rocker arms are supported on an end facing towards the at least one gas exchange valve so that the two rocker arms can pivot with respect to one another.

17. The cam drive according to claim 1, wherein the rocker arm is formed in two parts and has a rocker arm element comprising an inside arm supported therein, wherein the actuating element rests in a first position against the rocker arm element so that the rocker arm carries out an oscillating tilting movement which causes an actuating of the associated at least one gas exchange valve, while the actuating element, in a second position, rests in a displaceable manner with respect to the rocker arm element against the inside arm so that the rocker arm element carries out a tilting movement about a free end of the second arm without causing an actuating of the associated at least one gas exchange valve.

18. The cam drive according to claim 1, wherein the rocker arm is formed in two parts having two rocker arms which work independent from one another, each of the two rocker arms having one cam follower which works independent from the other, and where each of the two rocker arms are supported on an end facing towards the at least one gas exchange valve so that the two rocker arms can pivot with respect to one another.

19. The cam drive according to claim 18, wherein the rocker arm including the two rockers arms has an outer and an inner rocker arm.

20. The cam drive according to claim 19, wherein the actuating element rests in a first position against the outer rocker arm so that the outer rocker arm is in contact with a first cam of the camshaft and carries out an oscillating tilting movement, which causes an actuating of the at least one gas exchange valve of the associated cylinder, and in a second position, the actuating element rests against the inner rocker arm so that the inner rocker arm is in contact with a second cam of the camshaft and carries out an oscillating movement, which causes a varied actuating of the associated at least one gas exchange valve in comparison with the first position.

* * * * *